US006328767B1

(12) United States Patent
Nishi

(10) Patent No.: US 6,328,767 B1
(45) Date of Patent: Dec. 11, 2001

(54) YARN WITH PARTIAL DYED SIDE SURFACE AND DEVICE FOR ADHERING DYE LIQUID TO DRYING AND TAKING UP THE SAME

(75) Inventor: Nobuyasu Nishi, Ichinomiya (JP)

(73) Assignee: Nishi Nenshi Co., Ltd., Aichi-ken (JP)

( * ) Notice: Subject to any disclaimer, the term of this patent is extended or adjusted under 35 U.S.C. 154(b) by 0 days.

(21) Appl. No.: 09/239,541

(22) Filed: Jan. 29, 1999

(51) Int. Cl.[7] ..... D06B 1/02; D06B 1/14

(52) U.S. Cl. ..... 8/149.1; 8/158; 68/5 D; 68/20; 68/202; 68/205 R

(58) Field of Search ..... 8/149, 149.1, 158; 68/5 D, 20, 205 R, 200, 202, 203

(56) References Cited

U.S. PATENT DOCUMENTS 3,906,757 * 9/1975 Arimoto et al. ..... 68/200 X
4,047,271 * 9/1977 Paterson et al. ..... 8/149 X
4,153,961 * 5/1979 Cleveland ..... 8/149
4,485,508 * 12/1984 Otting ..... 68/205 R X
4,547,921 * 10/1985 Otting et al. ..... 68/205 R X
5,325,556 * 7/1994 Stewart, Jr. et al. ..... 68/205 R X
5,557,953 * 9/1996 Massotte et al. ..... 68/205 R

* cited by examiner

*Primary Examiner*—Philip R. Coe
(74) *Attorney, Agent, or Firm*—Sughrue Mion, PLLC

(57) ABSTRACT

The invention provides a partial dyed yarn having a partial dyeing applied to a side surface of fibrous raw material and further provides a method for manufacturing thereof. A partial dyed yarn is provided by a dye liquid adhering method and a dye liquid adhering, drying and taking-up device which is capable of accomplishing a high quality dye printing yarn. A continuous fibrous raw material is passed through the dye liquid adhering roll, the dye liquid is partially or continuously adhered to the thread-like side surface of the fibrous raw material, and thereafter it is applied with a heat treatment to cause the yarn to be dyed in a desired color tone efficiently and quickly. The fibrous raw material is passed over a guiding groove formed at an outer circumference of the dye liquid adhering roll at a desired yarn speed while a tension force is being applied to it, the dye liquid adhering roll is properly rotated with its frictional force and at the same time, its amount of adhesion is controlled and the yarn is passed in a hot air drying device while it is turned therein so as to dry the adhered dye liquid. The yarn is then taken up as a dried cone and it is processed with heat treatment to obtain a yarn partially dyed on the side surface thereof.

1 Claim, 8 Drawing Sheets

YARN WITH PARTIAL DYED SIDE SURFACE AND DEVICE FOR ADHERING DYE LIQUID TO DRYING AND TAKING UP THE SAME

BACKGROUND OF THE INVENTION

1. Field of the Invention

This invention relates to a partial dyed yarn having a partial dye formation applied to a side surface of a fibrous raw material of which dyeing and processing in the prior art dye adhering method were difficult and further relates to a partial dye adhering at the side surface of a yarn capable of generating a deep color tone in a product or a high quality look when the yarn is applied in a fabric or a knitted product or the like and to a device for adhering dye liquid to, drying and taking-up the same.

2. Description of the Prior Art

In general, the prior art dye adhering method applied to various kinds of fibrous raw materials such as yarn-like natural fibers, animal fibers (wool, wild animal hairs, silk or the like), synthetic fibers, semi-synthetic fibers or the like (hereinafter called as "fibrous raw materials") had an object to perform a dyeing operation in such a way that a uniform dye adhering state could be attained at a cross-sectional shape with the dye adhered yarn being cut like a ring, wherein a large amount of an entire dye adhering operation was carried out concurrently through a cone dye adhering operation or hank dyeing operation or the like. In addition, although it was known to apply a so-called printed dyeing technology in which a plurality of separators are press contacted with a hank-like fibrous raw material stored in a container, in particular, and a plurality of kinds of dye liquids having different color tones are dyed by every specified amount to each of the portions separated by the separators, it was normally defined as a superior technology in which a sectional surface of each of the color tones in a hank is uniformly adhered with dye though its color tone is partially different. In addition, as for the melange yarn or the like in the prior art, although it was defined as one in which a part of the raw material fiber such as a raw cotton or the like is dyed in advance, it is spinned under a state in which the raw material fibers having a plurality of colors are mixed to each other to show a color tone of melange yarn, such a process as above required as an essential requirement that its process passed through the spinning step, it took much amount of time in processing product and it could not fulfill the modern needs of increasing in processing speed so as to attain a new and unique color tone. In addition, in the case that a fabric or a knitted product similar to a natural animal skin in the natural field is processed, a printing was carried out for a piled surface, thereby some desired picture patterns were dyed, although a substantial uniform state could be attained ranging from the root portion to the tip portion. In such a prior art dye processing operation, the partial dyeing against the side surface of the yarn-like fibrous raw material was impossible and even in the case that the dyed yarn was applied in the fabric or the knitted product, it was not possible to apply the deep color tone as well as the mixed state or the like and further it was not possible to process the product to have a high quality look and feel.

With such a foregoing arrangement as above, the present invention improves the problems in the prior art dye adhering and processing operation and it is an object of the present invention to provide a partial dyed yarn, a method for adhering dye liquid and a device for adhering the dye liquid, drying it and taking-up the dye liquid in which a continuous fibrous raw material is passed through the dye liquid adhering roll to adhere the dye liquid to the material, thereafter it is merely applied with a heat treatment to perform a speedy color dyeing to a desired color tone a higher quality such as a deep color or mixed taste or the like than those of the prior art melange yarn can be generated.

DISCLOSURE OF THE INVENTION

The present invention is carried out such that a part of the side surface of the optional continuous fibrous raw material spinned and processed is applied with dye partially in a continuous or intermittent manner, wherein the present invention provides a partial dye adhered yarn having a high class grade color tone in which the fibrous raw material is passed through the dye liquid adhering roll, thereby the dye liquid is adhered to the material and a heat treatment is applied to it.

In addition, the present invention provides a dye liquid adhering, drying and taking-up device characterized in that the fibrous raw material is passed over a guide groove formed at an outer circumference of a dye liquid adhering roll at a desired yarn speed while a proper tension force is being applied to the material, the dye liquid adhering roll is properly rotated with its frictional force and at the same time the dye liquid is adhered to the side surface of the fibrous raw material in a continuous or intermittent manner while its adhering amount is being controlled, the adhered dye liquid is further dried while the material is being turned in the hot air drying device and passed and then the material is taken up as a dried cone.

PREFERRED EMBODIMENTS OF THE INVENTION

Referring now to the accompanying drawings, each of the preferred embodiments of the present invention will be described in more detail in reference to a partial yarn dyeing at a side part of the yarn, a method for adhering dye liquid to the yarn and a dye liquid adhering, drying and taking-up device.

[Preferred Embodiment No. 1]

Figure 1:
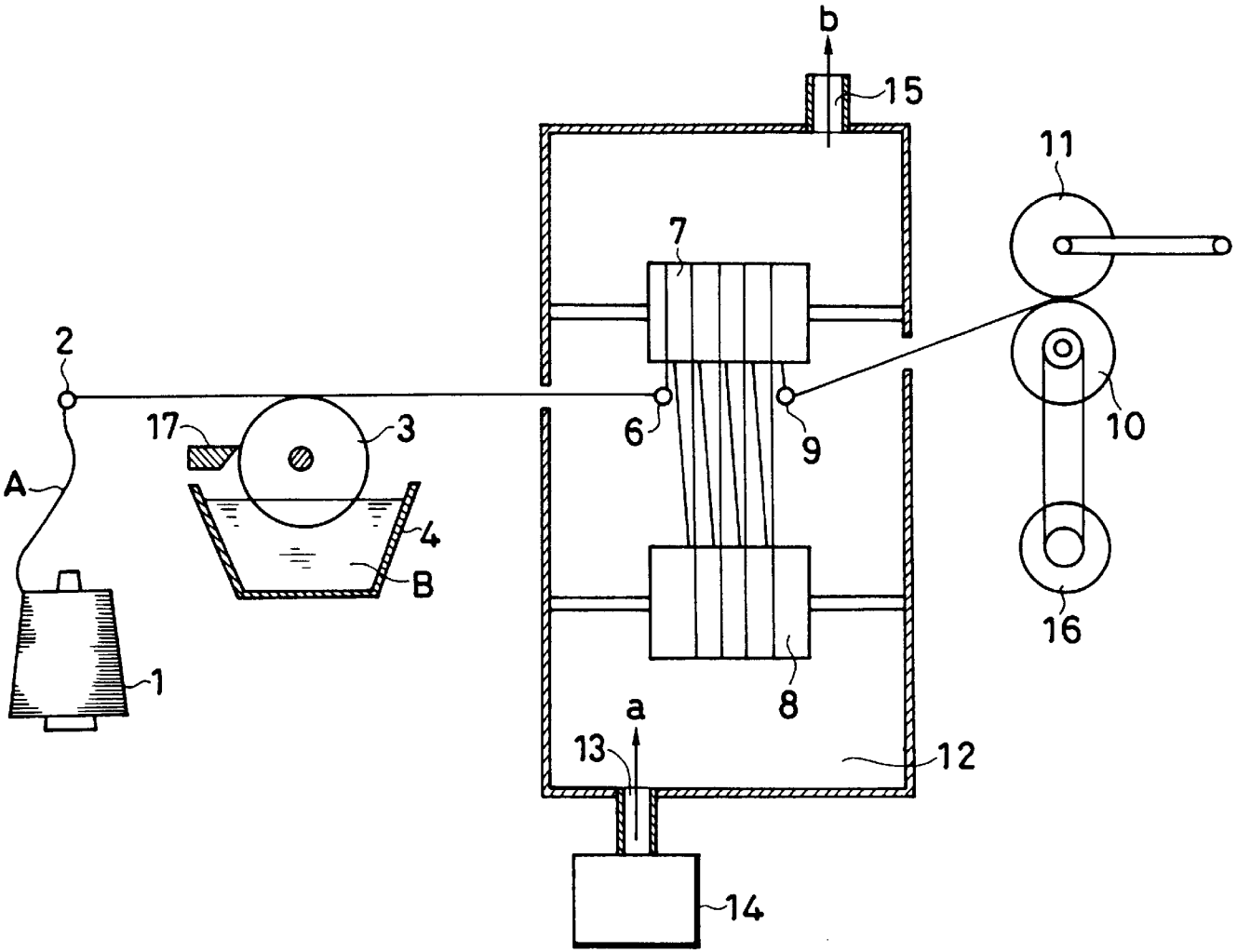
FIG. 1 is an illustration for showing a dye liquid adhering, drying and taking-up device in accordance with a first preferred embodiment used in the present invention.
Figure 2:
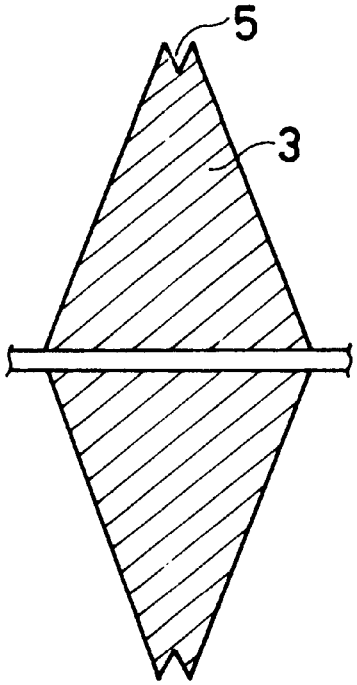
FIG. 2 is a side sectional view for showing a dye liquid adhering roller installed similarly in this dye liquid adhering, drying and taking-up device.

FIG. 1 illustrates a dye liquid adhering, drying and taking-up device of a first preferred embodiment used in the present invention and FIG. 2 is a side sectional view for showing a dye liquid adhering roller similarly installed in the dye liquid adhering, drying and taking-up device, wherein the raw material used in the preferred embodiment is described in reference to the case in which a double-yarn of wool No. 48 wound like a cone 1 is applied as a supplied fibrous raw material A, although it is of course apparent that it is not necessarily restricted to the aforesaid double-yarn wool No.48.

The dye liquid adhering, drying and taking-up device in the preferred embodiment is comprised of a dye liquid adhering roller 3 for adhering dye liquid B to a supplied fibrous raw material A passing through a guide 2 at a predetermined yarn speed; a dye liquid pan 4 arranged below the dye liquid adhering roller 3 and storing dye liquid B therein; rotary drums 7, 8 for immersing a part of a guiding groove 5 circumferentially formed at an outer circumference of the rotating dye liquid adhering roller 3 (refer to FIG. 2), adhering the dye liquid B to it, thereafter winding the supplied fibrous raw material A adhered with the dye liquid B by an optional number of turns through a guide 6; a box type hot air drying device 12 for finishing the supplied fibrous raw material A it into a dried cone 11 while the raw material A is being taken up through a guide 9 toward a taking-up drum 10; a hot air generating device 14 for feeding hot air into the box type hot air drying device 12 through a hot air inlet port 13 (indicated by an arrow a); and a hot air discharging port 15 through which hot air circulated within the box type hot air drying device 12 is discharged (indicated by an arrow b). The aforesaid guide 6, rotary drums 7, 8 and guide 9 are installed within the box type hot air drying device 12, wherein the drum 10 is applied with a rotating force by a driving device 16 such as a motor or the like, generates a predetermined tension force while taking up the supplied fiber A and further rotates the aforesaid dye liquid adhering roller 3 and the rotary drums 7, 8, respectively. The requisite amount of dye liquid B adhered to the guide groove 5 of the dye liquid adhering roller 3 is scraped off by a dye liquid adhering control device 17 contacted with the dye liquid adhering roller 3 and any surplus dye liquid B is not adhered to the supplied fibrous raw material A. In addition, although this dye liquid adhering roller 3 is normally made of stainless steel, its material quality is changed to enable an amount of adhesion of dye liquid B to be adjusted.

That is, the supplied fibrous raw material A is applied over the guiding groove 5 of the dye liquid adhering roller 3 from the cone 1 through the guide 2, a tension force is generated properly at the supplied fibrous raw material A by a refracting resistance generating device or the like (not shown) installed at the guide part 2 and then the aforesaid dye liquid adhering roller 3 is rotated by a frictional force generated by this tension force and the supplied fibrous raw material A is caused to run over the guide groove 5 while an amount of adhering of the dye liquid B against the guide groove 5 of the dye liquid adhering roller 3 is being controlled by a dye liquid adhering controller 17. A resistance force applied by the aforesaid refracting resistance generating device is changed properly to adjust an amount of dye liquid adhered to the dye liquid adhering roller 3 and it becomes possible to perform an adjustment in compliance with a concentration of the dye liquid B. Any number of turns of the supplied fibrous raw material A having the dye liquid B adhered thereto are wound through the guide 6 between the rotary drum 7 and the rotary drum 8 spaced apart and arranged within the box type hot air drying device 12, fed out of the box type hot air drying device 12 through the guide 9, wound while the taking-up drum 10 is being rotated by the driving device 16 and finished up into the dried cone 11.

Figure 3:
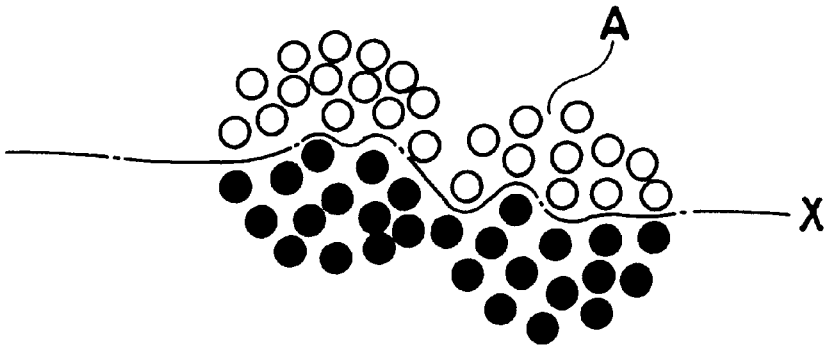
FIG. 3 is a cross sectional illustration for showing a fibrous bundle after dyeing attained by the first preferred embodiment.

This dried cone 11 is heat treated by a steamer (not shown) at 98° C., for example, for 30 minutes, thereby the adhered dye liquid B is completely dyed to the supplied fibrous raw material A. FIG. 3 is a sectional view for showing a state of partial dyed yarn in the case in which the double yarn of wool No. 48 is used as the supplied fibrous raw material A, wherein each of the fibers divided by a line X and colored black (colour phase to be dyed is optional) is dyed and processed as a partial dyed yarn.

In addition, in the case that synthetic fibrous raw material such as polyester or the like is used, it is necessary to perform a heat treatment at 130° C. and for 60 minutes, for example, and the aforesaid heat treatment temperature and heat treatment time are made different from each other in compliance with the type of supplied fibrous raw material.

[Preferred Embodiment No. 2]

Figure 4:
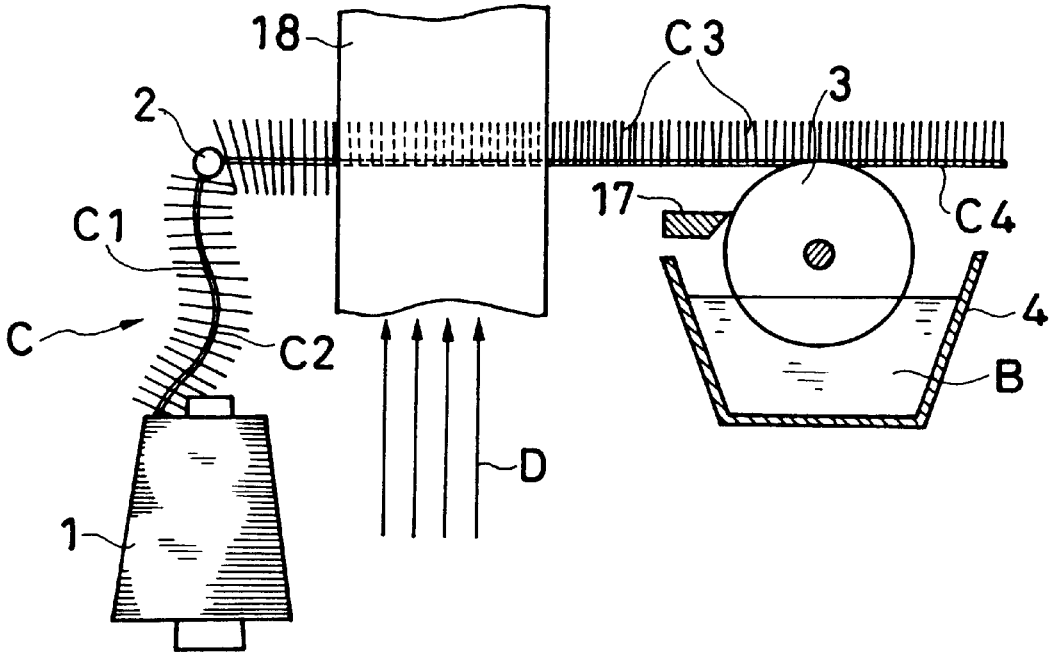
FIG. 4 is an illustration for showing a second preferred embodiment of the dye liquid adhering, drying and taking-up device of the present invention and a state in which an air blowing pipe is arranged before a dye liquid adhering roller of the dye liquid adhering, drying and takingup device in the first preferred embodiment.

FIG. 4 illustrates a part of a dye liquid adhering, drying and taking-up device for showing a second preferred embodiment of the case in which dye liquid is adhered to the chenille yarn C applied as the supplied fibrous raw material A, wherein it shows a state in which an air blowing pipe 18 is arranged before the dye liquid adhering roller 3 of the dye liquid adhering, drying and taking-up device in the aforesaid first preferred embodiment.

In the preferred embodiment, the aforesaid chenille yarn C is made such that the central part of fancy yarn C3 such as acrylic long fiber filaments of 150 deniers and 60 filaments cut to about 50 mm is held between two core yarns C1 and C2 with acrylic span double yarn No. 48 being twisted in S-shape (rightward twisting) by 800 times, for example, and then they are twisted by about 450 times/m in Z-twisted (leftward twisting) form. In the figure, the air blowing pipe 18 is mounted between the guide 2 and the dye liquid adhering roller 3 as described above, and then a proper amount of blown air D can be fed from its lower side toward its upper side. The chenille yarn C is passed in the aforesaid air blowing pipe 18, thereby almost of the fancy yarn C3 is displaced by about 25 mm in an upward direction. The chenille yarn C is caused to pass through the air blowing pipe 18 and further pass over the guide groove 5 of the dye liquid adhering roller 3 while the fancy yarn C3 is being faced upward with blowing air D. At this time, the dye liquid B adhered to the guide groove 5 of the dye liquid adhering roller 3 is adhered to root portions C4 of the core yarns C1 and C2 of the chenille yarn C and the fancy yarn C3.

The chenille yarn C having the dye liquid B adhered thereto is fed into the box type hot air drying device 12 and dried there, taken up by the taking-up drum (not shown) in the same manner as that of the first preferred embodiment and finished into the dried cone. After this operation, this material is processed with heat treatment at 98° C. for 30 minutes, for example, by a steamer (not shown) and then the adhered dye liquid B is completely dyed to the chenille yarn C.

Figure 5:
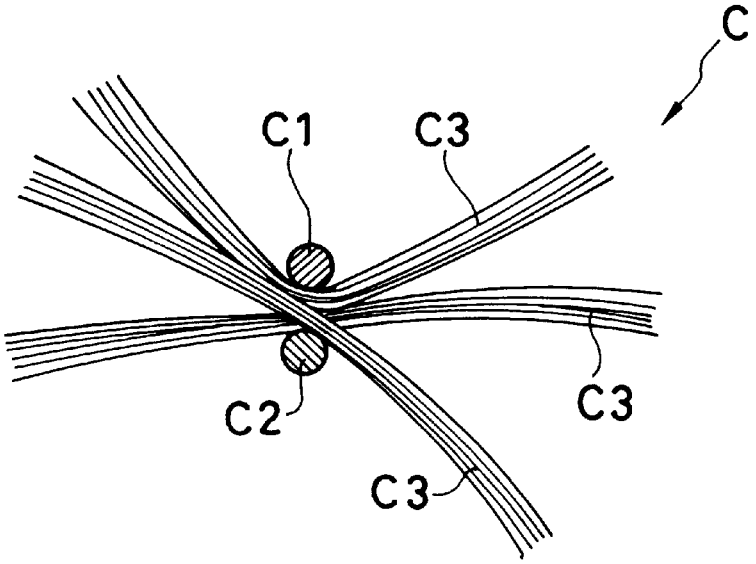
FIG. 5 is an illustration for showing a chenille yarn after dyeing attained by a second preferred embodiment.

FIG. 5 is a sectional view for showing the chenille yarn C after the dye printing treatment is applied, wherein it shows that only the root portions C4 of the core yarns C1, C2 and the fancy yarn C3 are printed with dye and it is left with the outside part (the extremity end side) of the fancy yarn C3 being not printed by dye. In addition, in the case that the dried cone is set in the steamer, it is sometimes found that the adhered dye liquid B is oozed out at the non-adhered portion. Due to this fact, water-soluble glue is mixed in the dye liquid to apply a certain stickiness to the dye liquid B, resulting in that the oozed out state can be adjusted.

Figure 6:
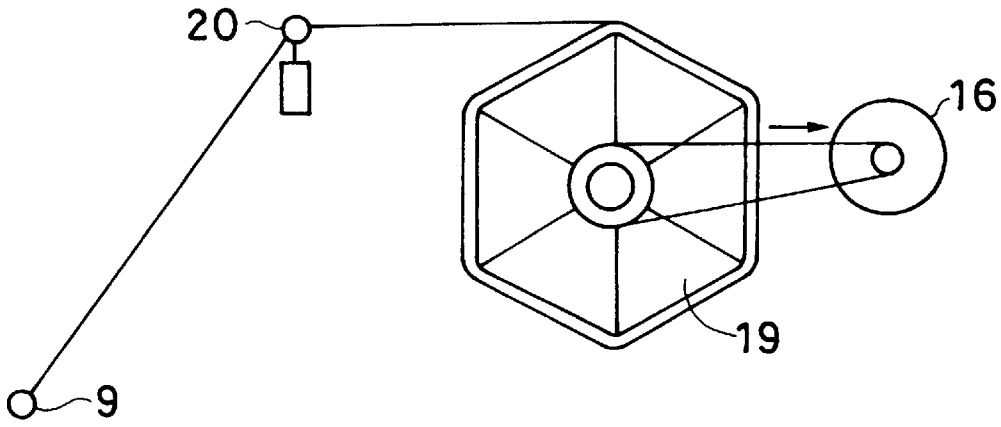
FIG. 6 is an illustration for showing a device for finishing a partial dyed yarn installed in a dye liquid adhering, drying and taking-up device of the second preferred embodiment.
Figure 7:
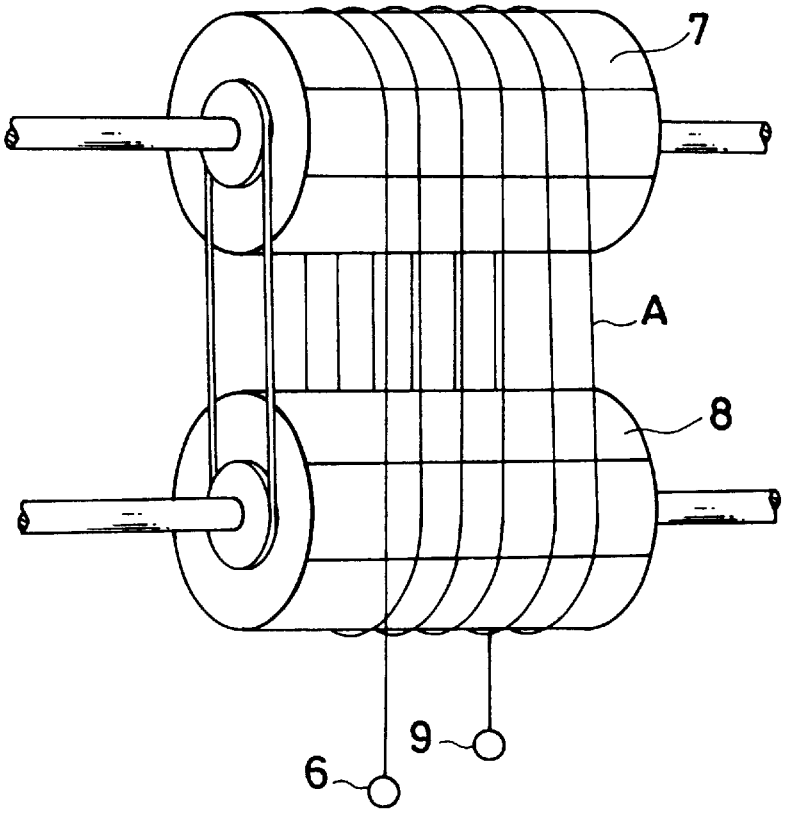
FIG. 7 is similarly an outer appearance illustration for showing rotary drums.

In addition, FIG. 6 shows a state in which a hank taking-up device 19 is constructed in place of the taking-up drum 10 in the dye liquid adhering, drying and taking-up device shown in FIG. 1 and at the same time a hank swinging guide 20 is arranged between the guide 9 and the hank taking-up device 19, resulting in that the supplied fibrous raw material A after its dried state can be finished into a uniform taken-up hank. In addition, FIG. 7 shows an illustration of outer appearance to indicate a structure of each of the rotary drums 7, 8 constructed within the box type hot air drying device 12 shown in FIG. 1.

[Preferred Embodiment No. 3]

Figure 8:
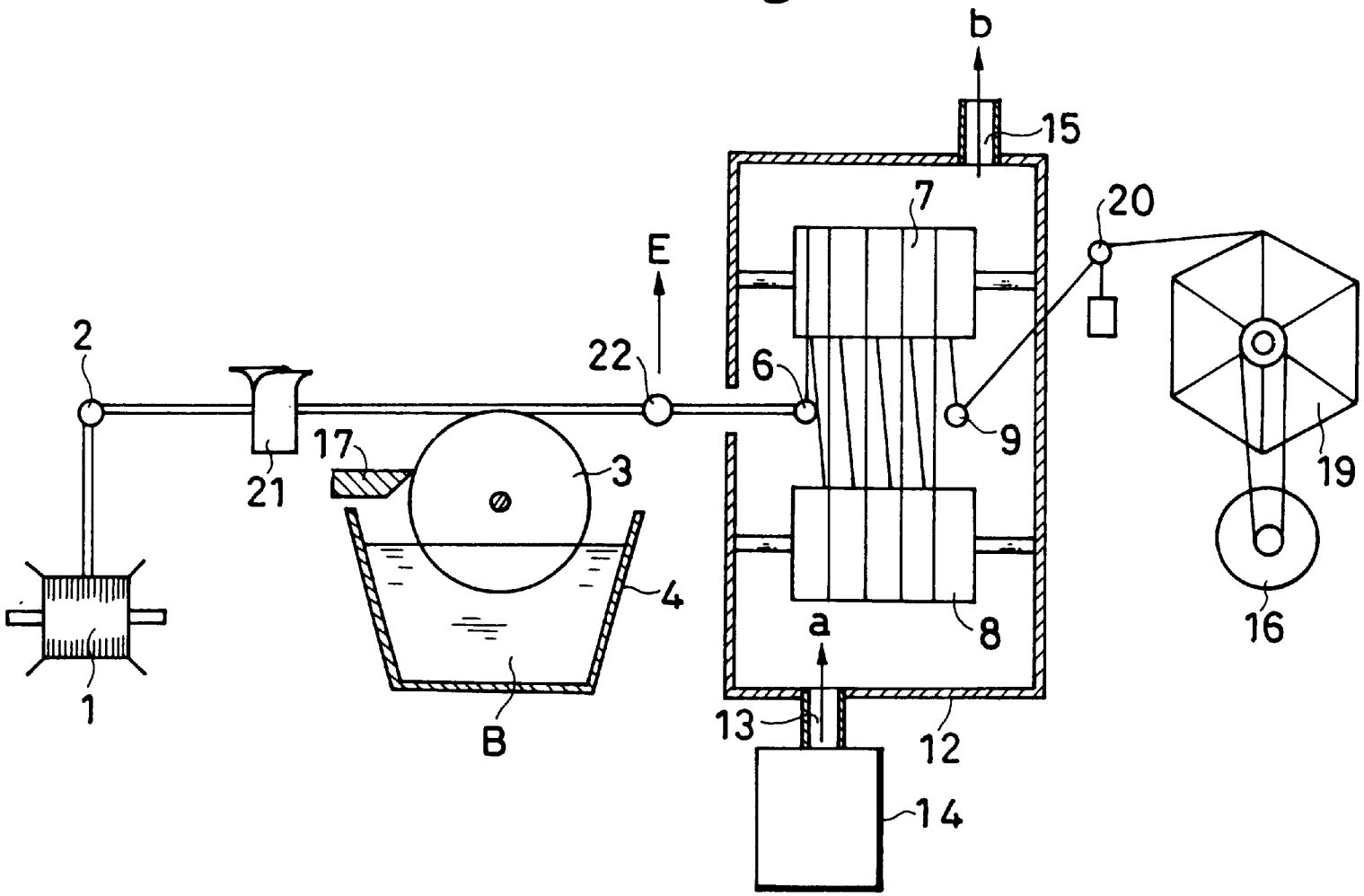
FIG. 8 is an illustration for showing a state in accordance with a third preferred embodiment of a dye liquid adhering, drying and taking-up device of the present invention and having a liquid adhering control device added thereto.

FIG. 8 illustrates a dye liquid adhering, drying and taking-up device indicating a third preferred embodiment in the case that dye liquid is adhered to a flat tape-like tape yarn applied as a supplied fibrous raw material A, wherein one side of the tape yarn is caused to pass through a flat state keeping device 21 arranged between the guide 2 and the dye liquid adhering roller 3, the tape yarn is properly moved up and down (indicated by an arrow E) at its running location by a lift-up guide 22, a lower side surface of the tape yarn is set to be passed in the guide groove 5 of the dye liquid adhering roller 3 intermittently or continuously, passed through the guide 6 constructed in the box type hot air drying device 12, the rotary drums 7, 8 are rotated while the tape is wound by a plurality of turns between the drums, the tape is fed out of the box type hot air drying device 12 through the guide 9 and then the tape is uniformly taken up into the hank taking-up device 19 by the hank swinging guide 20 and formed into a hank.

Figure 9:
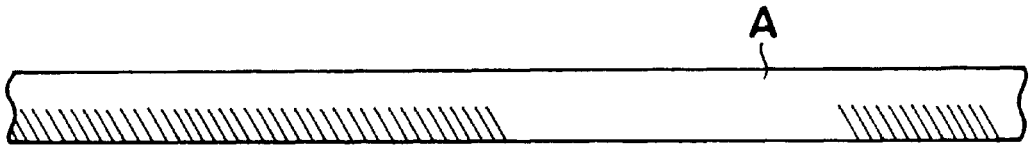
FIG. 9 is a side elevational view of a tape dyed in accordance with a third preferred embodiment.
Figure 10:
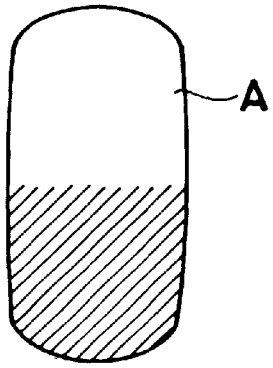
FIG. 10 is similarly a cross sectional illustration for showing a dyed tape yarn.

A bundle of dried hanks taken up into hank is processed with a steamer at 98° C. for 30 minutes, for example, and dyed with dye partially and intermittently. FIG. 9 illustrates a state of side surface of the supplied fibrous raw material A partially and intermittently dyed by the aforesaid dye adhering method, i.e. the tape yarn, wherein the portion indicated by a hatched line in the figure is adhered with dye. In addition, FIG. 10 illustrates a sectional view for showing the tape yarn adhered with dye, wherein the tape yarn is contacted with the guide groove 5 of the dye liquid adhering roller 3 and only the side surface of the lower part adhered with dye liquid is adhered with dye.

[Preferred Embodiment No. 4]

Figure 11:
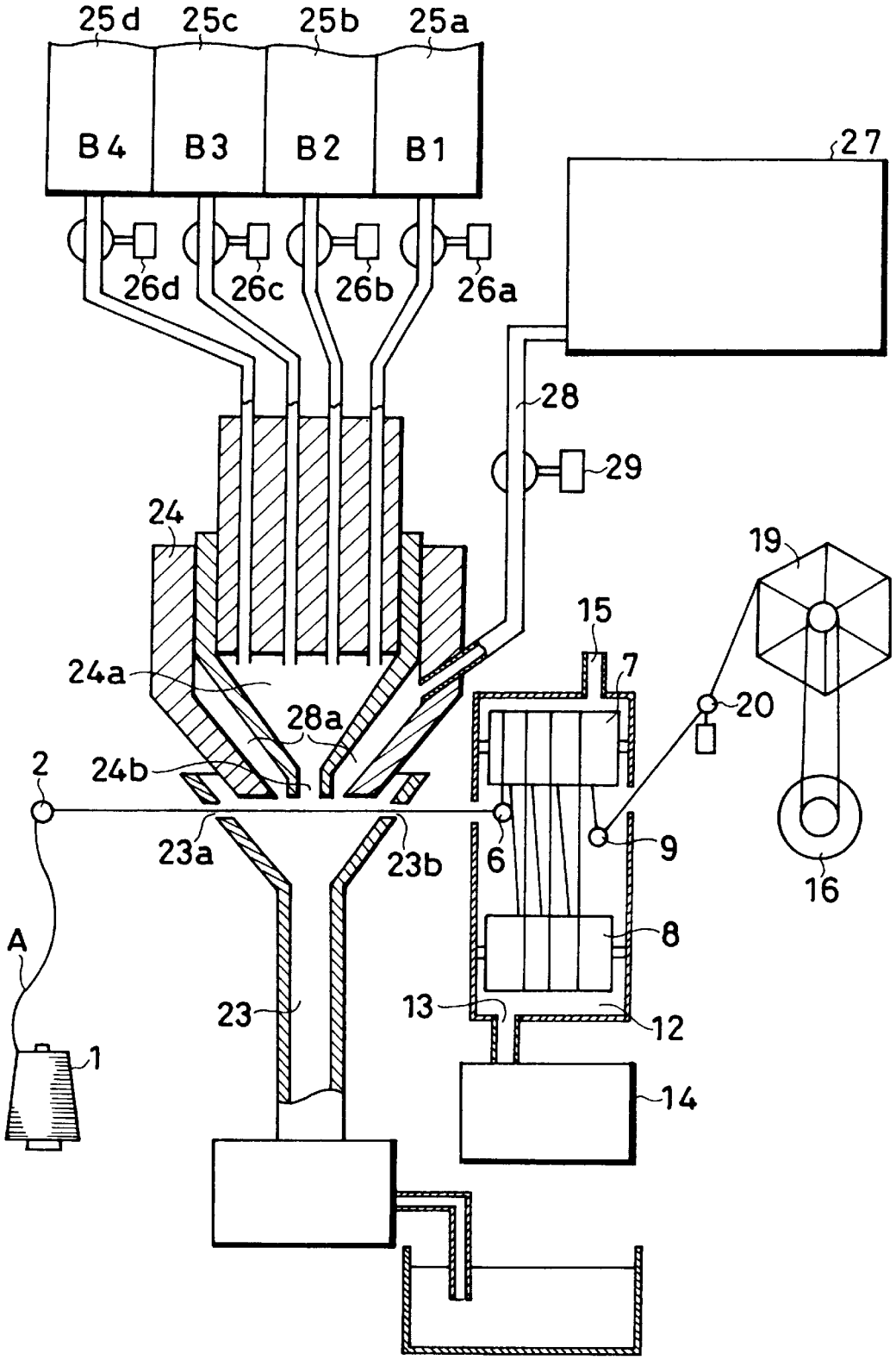
FIG. 11 is an illustration for showing a dye liquid adhering, drying and taking-up device related to a fourth preferred embodiment of the present invention and for use in adhering dye liquid to a side surface of fibrous raw material of printed dye touch.

FIG. 11 illustrates a dye liquid adhering, drying and taking-up device in accordance with a fourth preferred embodiment applied in the present invention, wherein dye liquid having a plurality of colour phases is atomized properly and automatically against the supplied fibrous raw material A in place of the dye liquid adhering method carried out with the dye liquid pan 4 used in the first to third preferred embodiments and then the dye liquid is adhered in such a way that the dye adhering portions with partial different colour phases may appear at the side surface of the continuous supplied fibrous raw material A.

That is, this preferred embodiment of the present invention represents an example in which acrylic mono-filament No. 10 acting as the supplied fibrous raw material A is used, wherein a dye liquid atomization device for use in atomizing dye against the aforesaid supplied fibrous raw material A running through the guide 2 toward the box type hot air drying device 12. This dye liquid atomization device is comprised of a suction pipe 23 for laterally running and passing the supplied fibrous raw material A above itself, an atomization nozzle 24 constructed above the suction pipe and a plurality of dye liquid tanks 25 for supplying a plurality of kinds of dye liquids B having different colour tones to the atomization nozzle 24, wherein each of the dye liquid tanks 25, 25 . . . is connected to the atomization nozzle 24, a solenoid valve 26 arranged in the midway part of this connecting system so as to make an optional adjustment of a supplying amount of dye liquid B supplied to the atomization nozzle 24 is properly operated by an automatic control device (not shown), one or more kinds of dye liquids are supplied into the dye liquid accumulation part 24*a* and at the same time high pressure air is injected from an injection port 28*a* of an air pipe 28 extending from another constructed compressor 27 opened at the atomization port 24*b* of the aforesaid atomization nozzle 24, thereby an inside part of the dye liquid accumulation part 24*a* is reduced in its pressure, each of the dye liquids B is sucked toward the suction pipe 23 and atomized and then the dye liquid B is adhered to the side surface of the supplied fibrous raw material A passing through yarn passage holes 23*a*, 23*b* opened at the upper side surface of the suction pipe 23. An amount of injection of high pressure air is controlled by appropriate opening or closing of the solenoid valve 29 arranged in the midway part of the air pipe 28, wherein the supplied fibrous raw material A having dye liquid adhered at a side surface thereof passes through the yarn passage holes 23*a*, 23*b* and is guided into the box type hot air drying device 12, the material A is wound around the rotary rollers 7, 8 by several turns, dried while the rotary rollers 7 and 8 are being properly rotated, the material A passes by the swinging guide 20 through the guide 9 and taken up onto the hank taking-up device 19.

In this preferred embodiment, each of "red dye liquid", "yellow dye liquid", "blue dye liquid" and "black dye liquid" or the like is stored in advance in each of a plurality of dye liquid tanks 25*a*, 25*b* . . . , and the solenoid valve 26*a* in the dye liquid tank 25*a* having red dye liquid B1 stored therein is released to open for 20 seconds while the supplied fibrous raw material A is being passed at a yarn speed of 30 m/min, for example, to adhere red dye liquid of 10 m and then each of the solenoid valves 26*b*, 26*c* of the dye liquid tank 25*b* having the yellow dye liquid B2 stored therein and the dye liquid tank 25*c* having the blue dye liquid B3 stored therein is released to open for 6 seconds, the dye liquid of 50% is injected from each of the dye liquid tanks 25*b*, 25*c* to adhere the dye liquid mixed to show a color green, and further each of the yellow dye liquid B2 of 60%, the red dye liquid B1 of 20% and the blue dye liquid B3 of 20% is released for 40 seconds, respectively, to adhere the dye liquid mixed to a color charcoal, and in the case that the black dye liquid B4 of 1 m is adhered, the solenoid valve 26*d* of the dye liquid tank 25*d* having the black dye liquid B4 stored therein is released to open for 2 seconds, thereby a plurality of coloring sections of different colour tones can be processed continuously or intermittently against the side surface of the continuous supplied fibrous raw material A.

It is of course apparent that the kind of colour phases of the aforesaid dye liquid B or the number of dye liquids and their combination, the number of dye tanks 25 to be constructed as the device or their connecting systems can be changed optionally and worked.

In addition, in this preferred embodiment of the present invention, it is possible to adhere dye liquid freely to the supplied fibrous raw material of printed dye such as a red system of 10 m, a green system of 3 m a charcoal system of 20 m, and a black system of 1 m by properly atomizing dye liquid B during a time in which the supplied fibrous raw material A is passing through the guides 2 and 6, the supplied fibrous raw material A dried and taken up in a hank form is set in a steamer (not shown), processed with heat treatment at about 98° C. for 30 minutes, resulting in that each of the colour tones are dyed.

[Preferred Embodiment No. 5]

Figure 12:
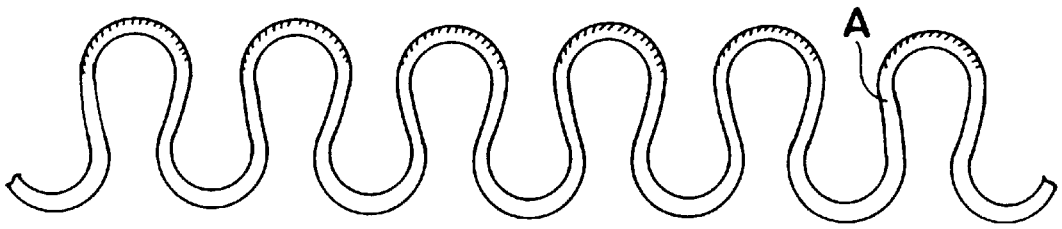
FIG. 12 is a sectional illustration for showing a dyed state in which a print is applied to a knitted product with partial dye yarn attained by the present preferred embodiment.

As shown in FIG. 12, after the supplied fibrous raw material A is changed into a knitted base material by a weft knitting machine, its surface is entirely printed and it is rewound after being applied as a printed base material, thereby only the part at the surface side of the fibrous raw material can be printed with dye. The hatched line part in FIG. 12 represents a part where the printed base material is rewound and adhered with dye under its threaded state.

Figure 13:
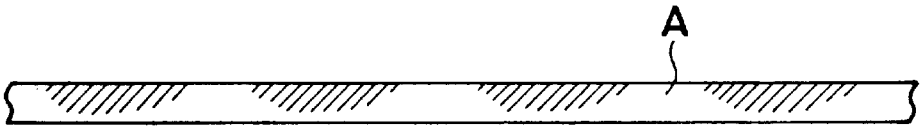
FIG. 13 is an illustration for showing a state in which a knitted product after dyeing in the preferred embodiment is rewound.

In addition, it is also possible to attain the partial dyed thread having a sectional surface as shown in FIG. 13 by a method wherein the thread or yarn dyed in advance in the supplied fibrous raw material A is concurrently changed into a knitted base material by a weft knitting machine and after it is changed to a base material with dye in its entire surface being removed to form white color, it is rewound and changed into thread or yarn.

Effects of the Invention

The fibrous raw material adhered with dye and processed in accordance with the present invention can be utilized as a fibrous raw material for a fabric or a knitted product and in the case that the chenille yarn is applied in a fabric or a knitted product, for example, a root part of the thread is thick and the leading end of the thread is not applied with dye, so that it is possible to express a surface of product showing a deep color tone and at the same time the present invention can resolve the problem which could not be resolved in the prior art.

Further, in accordance with the dye liquid adhering, drying and taking-up device of the present invention, a part of the side surface of the continuous fibrous raw material can be adhered with dye continuously or intermittently, resulting in that the prepared fibrous raw material can be adhered with dye in compliance with optional colour tone to enable a mixed feeling or a high-grade feeling to be generated.

What is claimed is:

1. A method of manufacturing a partial dyed thread, wherein a deep colour tone is generated by adhering dye liquid to one of a lower side surface and an upper side surface of a thread, when viewed orthogonally to the longitudinal direction of the thread, said thread being continuously supplied fibrous raw material, wherein the dye liquid constitutes at least one of a plurality of dye liquids, which are selected from at least one of a plurality of dye liquid storing tanks which store a plurality of dye colors, so as to achieve a desired color tone; and guiding each of the plurality of dye liquids into an injection nozzle while amounts of the dye liquids are controlled by an automatic control device;

opening or closing a solenoid valve arranged in the midway part of an air pipe extending from a compressor to inject high pressure air to reduce pressure within the injection nozzle;

sucking and atomizing each of the dye liquids so that the dye liquids adhere to the one of the upper and lower side surface of the fibrous raw material;

drying the material with a box type hot air drying device;

taking up the dried and supplied fibrous raw material into a hank taking-up device; and applying heat treatment to adhere the dye with the side surface of the supplied fibrous raw material into a printed dye tone.

* * * * *